United States Patent [19]

English et al.

[11] 4,321,501

[45] Mar. 23, 1982

[54] LOW WATTAGE, HIGH PRESSURE METAL VAPOR DISCHARGE LAMP FOR MINIMIZING DETRIMENTAL GLOW TIME

[75] Inventors: George J. English, Reading; Harold L. Rothwell, Jr., Rowley; William M. Keeffe, Rockport, all of Mass.

[73] Assignee: GTE Products Corporation, Stamford, Conn.

[21] Appl. No.: 132,931

[22] Filed: Mar. 24, 1980

[51] Int. Cl.[3] ..... H01J 61/073

[52] U.S. Cl. ..... 313/197; 315/335

[58] Field of Search ..... 313/192, 197, 198

[56] References Cited

U.S. PATENT DOCUMENTS

| | | | |
|---|---|---|---|
| 2,582,367 | 1/1952 | Williams et al. | 313/192 X |
| 2,607,902 | 8/1952 | Townsend | 313/192 X |
| 2,729,762 | 1/1956 | Hagen et al. | 313/192 X |
| 2,928,013 | 3/1960 | Gawehn | 313/192 X |
| 3,394,280 | 7/1968 | Trumble | 313/192 X |

*Primary Examiner*—Paul L. Gensler

*Attorney, Agent, or Firm*—William H. McNeill

[57] ABSTRACT

A single ended, low-wattage, high pressure, metal vapor discharge lamp includes first and second main electrodes and an auxiliary electrode resistively coupled to one of the main electrodes. The lamp provides a glow region remote from the main arc region and keeps wall blackening confined to areas remote from the main arc region. The lamp starts easier and minimizes detrimental glow time.

2 Claims, 1 Drawing Figure

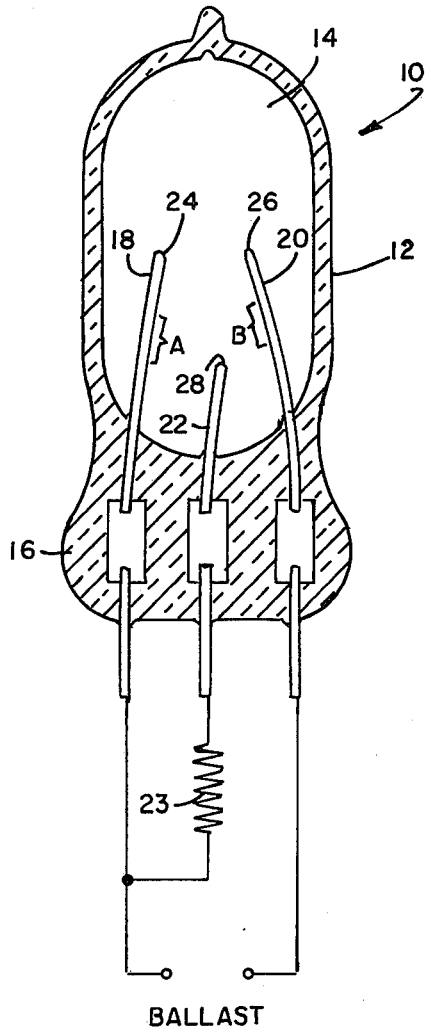
14
10
24
26
18
20
12
A
B
28
22
16
23
BALLAST

LOW WATTAGE, HIGH PRESSURE METAL VAPOR DISCHARGE LAMP FOR MINIMIZING DETRIMENTAL GLOW TIME

TECHNICAL FIELD

This invention relates to metal vapor discharge lamps and more particularly to such lamps which are single ended.

BACKGROUND ART

Metal vapor discharge lamps are employed where high brightness is desired or required, such as for projectors, and theater and studio lighting. Most of these lamps are double ended; i.e., the electrodes extend along a single longitudinal axis, and/or they are D.C. operated. Single ended arc lamps are known but suffer from high open circuit voltages necessitating massive ballasts, blackening of the arc chamber in the stable arc region and long transition times from full glow state to arc, thus allowing more time for sputtering and blackening to occur.

DISCLOSURE OF INVENTION

It is, therefore, an object of this invention to obviate the disadvantages of the prior art.

It is another object of the invention to enhance single ended discharge lamps.

These objects are accomplished, in one aspect of the invention, by the provision of a single ended, short arc, low wattage, high pressure, metal vapor discharge lamp designed primarily for operation on alternating current and which comprises first and second main electrodes terminating in an arc chamber. The improvement comprises an auxiliary electrode sealed in the lamps between the first and second electrodes.

This novel lamp provides an initial glow region remote from the arc region and thus confines wall blackening caused by electrode sputtering to an area less objectionable. The time period from full glow state to arc is minimized thus reducing the interval of detrimental glow state. And, with the auxiliary electrode resistively coupled to one of the main electrodes the initial breakdown condition is reduced, thus reducing the open circuit voltage necessary from the ballast supply circuit.

BRIEF DESCRIPTION OF THE DRAWING

The single FIGURE is a sectional view of a lamp of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawing.

Referring now to the drawing with greater particularity there is shown a metal vapor discharge lamp 10 of the single ended, short arc, low-wattage variety. Lamp 10 comprises a transparent body 12 of, for example, quartz, defining therein an arc chamber 14. An arc generating and sustaining medium as, for example, of mercury, mercury iodide, scandium and argon at a pressure of 200 torr, is present within chamber 14. Sealed within lamp 10 by seal area 16 are adjacent first and second main electrodes 18 and 20, which terminate within chamber 14.

Positioned between electrodes 18 and 20, but closer to one of them, for example 20, is an auxiliary electrode 22 which, externally of lamp 10, is resistively coupled as by resistor 23 to the other main electrode, in this instance, 18. Auxiliary electrode 22 has a height which is substantially less than the height of main electrodes 18, 20.

The arc region with this electrode configuration is between the terminal ends 24 and 26 of electrodes 18, 20. However, the initial glow region occurs at areas A, B which are at approximately the mid point of electrodes 18 and 20. Since the initial glow period is that time at which most wall blackening caused by electrode sputtering occurs it is advantageous to provide this location away from the arc region.

During cold start conditions a large electric field is maintained between auxiliary electrode 22 and main electrode 20 by the external ballast supply. When breakdown occurs a low pressure glow discharge is established between the tip 28 of electrode 22 and a point within or closely adjacent to area B on electrode 20.

As the glow current increases, the potential drop across resistor 23 increases also, forcing main electrode 20 and auxiliary electrode 22 to nearly the same potential.

As this point is reached a rapid glow-to-arc transition occurs between main electrode 18 and main electrode 20 within the areas A and B. This developed arc, within seconds, climbs up electrodes 18 and 20 and establishes itself in the main arc region between tips 24 and 26.

This lamp provides unique advantages over the single ended lamps proposed by the prior art. The initial breakdown condition is reduced by providing the auxiliary electrode, thus reducing the open circuit voltage necessary from the ballast. The unique configuration of the electrodes provides that the full glow state occurs in a region remote from the stable arc region and thus confines wall blackening caused by electrode sputtering during the glow state to a less objectionable area of the arc chamber. And, the transition from full glow state to arc occurs more rapidly in the areas A and B, thus minimizing the time interval of the detrimental glow state.

While there has been shown and described what is at present considered to be the preferred embodiment of the invention, it will be apparent to those skilled in the art that various changes and modifications can be made herein without departing from the scope of the invention as defined by the appended claims.

We claim:

1. In a single ended, short arc, low wattage, high pressure, metal vapor arc discharge lamp having a transparent body defining an arc chamber containing an arc generating and sustaining medium the improvement comprising: first and second main electrodes sealed in a seal area of said body and projecting into said arc chamber, said main electrodes having a given length within said arc chamber and converging towards each other over a substantial part of said length; an auxiliary electrode sealed in said seal area between said first and second main electrodes and projecting into said arc chamber, said auxiliary electrode having a length less than said given length and being positioned closer to said second main electrode; said converging first and second main electrodes defining therebetween as initial glow region at substantially the height of said auxiliary electrode and an arc region at the terminal ends thereof.

2. The lamp of claim 1 wherein said auxiliary electrode is resistively coupled to said first electrode.

* * * * *